US005899197A

United States Patent [19]

Watanabe et al.

[11] Patent Number: 5,899,197

[45] Date of Patent: May 4, 1999

[54] CRANKCASE VENTILLATION FOR OUTBOARD MOTOR

[75] Inventors: Hitoshi Watanabe; Noriyoshi Hirakoa; Masanori Takahashi, all of Hamamatsu, Japan

[73] Assignee: Sanshin Kogyo Kabushiki Kaisha, Hamamatsu, Japan

[21] Appl. No.: 09/140,153

[22] Filed: Aug. 26, 1998

[30] Foreign Application Priority Data

Sep. 12, 1997 [JP] Japan ..... 9-268115

[51] Int. Cl.[6] ..... F01M 13/04

[52] U.S. Cl. ..... 123/572; 123/184.42

[58] Field of Search ..... 123/572, 573, 123/574, 184.24, 184.42

[56] References Cited

U.S. PATENT DOCUMENTS

| | | | |
|---|---|---|---|
| 5,123,385 | 6/1992 | Sado et al. | 123/572 |
| 5,513,606 | 5/1996 | Shibata | 123/184.42 |
| 5,664,549 | 9/1997 | Hutchins | 123/572 |

*Primary Examiner*—Marguerite McMahon
*Attorney, Agent, or Firm*—Knobbe, Martens, Olson & Bear LLP

[57] ABSTRACT

An outboard motor having a multi-cylinder four-cycle, internal combustion engine as a power plant. An improved crankcase ventilating system is provided wherein the crankcase ventilating gases follow a circuitous path through the crankcase chamber, camshaft chambers and then to the intake system through an extended conduit passing over the exhaust manifold so as to reduce the emissions of hydrocarbons. The intake system is designed to preclude uneven distribution of the ventilating gasses.

18 Claims, 8 Drawing Sheets

CRANKCASE VENTILLATION FOR OUTBOARD MOTOR

BACKGROUND OF THE INVENTION

This invention relates to a crankcase ventilation arrangement for a four cycle engine and more particularly to a crankcase ventilation for an outboard motor.

It has been proposed to employ four cycle engines as the power plant in an outboard motor to replace the more conventionally utilized two cycle engine. One reason for this is the more environmentally friendly nature of a four cycle engine caused by the fact that the lubricant for such engine is recirculated rather than discharged along with the combustion products of the engine.

However, four cycle engines present some problems in connection with adaptation to outboard motor application. This is particularly true with respect to the feature which makes them advantageous over two cycle engines. That is, the recirculating lubricating system for a four cycle engine presents some problems in connection with placement, operation and location within outboard motors. This is primarily due to the extremely compact nature of an outboard motor.

It is also known to employ a crankcase ventilation arrangement for engines wherein the blowby gases from the cylinders are utilized to not only ventilate the engine but also are returned to the induction system rather than being discharged to the atmosphere. This minimizes the number of hydrocarbons that are emitted to the atmosphere.

However, in connection with the return of the crankcase blowby gases to the induction system, this must be done in such a way that it is ensured that any oil in the crankcase gases can be condensed and returned back to the lubrication system rather than deliver to the engine induction system. With the space available in the power head of an outboard motor, this means that it may be difficult to provide the effective separation of the oil from the crankcase blowby gases before it is introduced to the engine through its induction system.

It is, therefore, a principal object of this invention to provide an improved crankcase ventilation arrangement for an outboard motor.

It is a further object of this invention to provide an outboard motor crankcase ventilating arrangement that provides a long flow path to ensure good separation and nevertheless permits the gases to be delivered to the engine through its intake system.

In connection with the delivery of the crankcase gases to the engine combustion chambers for further combustion of any hydrocarbons therein, the return should be such that the crankcase gases are delivered substantially uniformly to each cylinder of a multiple cylinder engine. This is desirable to ensure that each cylinder experiences substantially the same combustion characteristics. This presents another problem that is unique to outboard motors.

In outboard motors, it is the general practice to position the engine so that the crankshaft rotates about a vertically disposed axis. This means that in multi-cylinder engines, the cylinders are placed one vertically above the other. This presents unique problems in ensuring that the crankcase ventilating gases that are returned to the engine through its induction system are uniformly distributed.

The hydrocarbons which may be present in the crankcase ventilating gases can cause the crankcase ventilating gases to have a greater density that the atmospheric air. Thus, the vertical disposition of the cylinders might tend to cause an arrangement wherein the lowermost cylinders receive a higher proportion of the crankcase ventilating gases in the uppermost cylinder.

It is, therefore, a still further object of this invention to provide an improved crankcase ventilating system for an outboard motor wherein the crankcase ventilating gases are distributed equally to the cylinders of the engine for further combustion of hydrocarbons therein.

SUMMARY OF THE INVENTION

This invention is adapted to be embodied in an internal combustion engine that has a cylinder block closed at one end by a crankcase member and at the other end by a cylinder head. The cylinder block defines at least one cylinder bore in which a piston reciprocates to form, in part, a combustion chamber. The piston drives a crankshaft that is rotatably journaled in the crankcase chamber formed by the crankcase member and the cylinder block. An overhead camshaft are mounted for rotation in a cam shaft chamber of the cylinder head for actuating at least one valve. A crankcase ventilating system is provided whereby the crankcase gases are delivered through the cylinder block from the crankcase chamber to the camshaft chamber. The engine is also provided with an induction system for delivering an air charge to the combustion chamber. The induction system includes a plenum chamber disposed along a side of the crankcase member opposite from the cylinder head. An atmospheric air inlet admits air into the plenum chamber at one side thereof. A ventilating gas conduit extends from the camshaft chamber along an exhaust side of the engine to the plenum chamber air inlet.

DETAILED DESCRIPTION OF THE PREFERRED EMBODIMENT OF THE INVENTION

Figure 1:
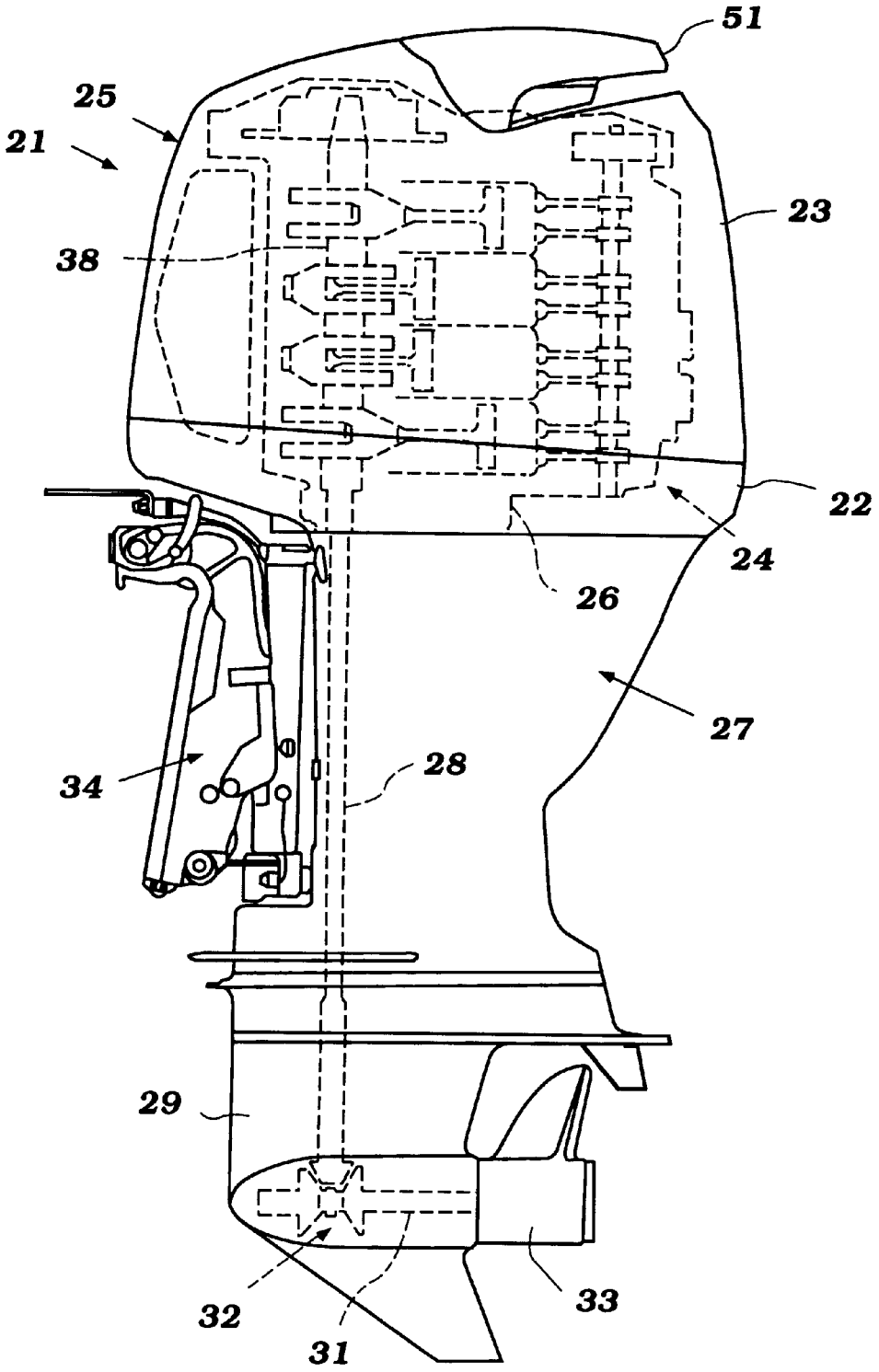
FIG. 1 is a side elevational view of an outboard motor constructed in accordance with an embodiment of the invention and illustrated in an orientation it would have if attached to the transom of an associated watercraft.

Referring now in detail to the drawings and initially to FIG. 1, this Figure illustrates an outboard motor, indicated generally by the reference numeral 21 in an orientation in which it would appear if attached to the transom of an associated watercraft. The outboard motor 21 includes a power head comprised of a lower tray portion 22 and a detachably connected, upper, main cowling portion 23. This cowling assembly surrounds an engine, identified generally by the reference numeral 24. Although the invention is described in connection with the outboard motor 21, it will be understood by those skilled in the art that the invention is capable of use with other applications than outboard motors. However, the invention has particular utility in conjunction with outboard motors due to the fact that they are designed so that their crankshaft rotates about the vertically extending axis for a reason which will become apparent shortly. The engine 24 forms a part of the power head of the outboard motor 21 and this power head is identified generally by the reference numeral 25.

The engine 24 is mounted on an exhaust guide plate 26 that is positioned at the upper end of a drive shaft housing and lower unit, indicated generally by the reference numeral 27. A driveshaft 28 is journaled in this drive shaft housing and lower unit 27 for rotation about a vertically extending axis. It is because of this orientation of the axis of drive shaft 28 that the engine 24 is mounted so that its crankshaft rotates about a vertically extending axis. This is done so as to facilitate a direct connection between the engine crankshaft and the drive shaft 28.

The drive shaft 28 depends into a lower unit portion 29 of the drive shaft housing and lower unit 27. There, it drives a propeller shaft 31 selectively through a forward, neutral, reverse transmission 32. This type of transmission is well known in the art. A propeller 33 is affixed for rotation with the propeller shaft 31 so as to create a propulsion for the associated watercraft.

The outboard motor 21 is completed by a combined swivel bracket and clamping bracket assembly, indicated generally by the reference numeral 34 by which the outboard motor is attached to the transom of an associated watercraft in the orientation as seen in FIG. 1 for steering movement about a vertically extending axis and for tilt and trim movement about a horizontally extending axis.

The aforenoted description of the outboard motor is, as noted, so as to permit those skilled in the art to understand an environment in which the invention may be employed. Obviously, those skilled in the art will understand how to apply the invention's principles to any type of outboard motor structure or, as noted above, any arrangement where a four-cycle engine is positioned so that its crankshaft rotates about a vertically extending axis.

The construction of the engine 24 will now be described, initially by reference primarily to the remaining figures. In the illustrated embodiment, the engine 24 is of the four cylinder, inline type and operates on a four-stroke principle. Although the invention can be employed with engines having other cylinder numbers and other cylinder orientations, the four cylinder construction described will provide adequate information so as to permit those skilled in the art to be able to practice the invention with such other arrangements.

The engine 24 is comprised of a cylinder block 35 in which four horizontally extending, vertically spaced, cylinder bores 36 are formed. One end of the cylinder bores 36 is closed by a crankcase member 37 which is affixed to the cylinder block 35 in a manner to be described and which defines a crankcase chamber in which the engine crankshaft 38 rotates about a vertically extending axis.

The bearing arrangement for the crankshaft 38 is provided by bearing webs 39 (FIG. 2) that are formed in the cylinder block 35 and cooperating bearing portions 41 formed by the crankcase member 37. The crankcase member 37 is affixed to the cylinder block 36 in the area of these bearings and, if desired, at other locations by threaded fasteners 42.

Figure 2:
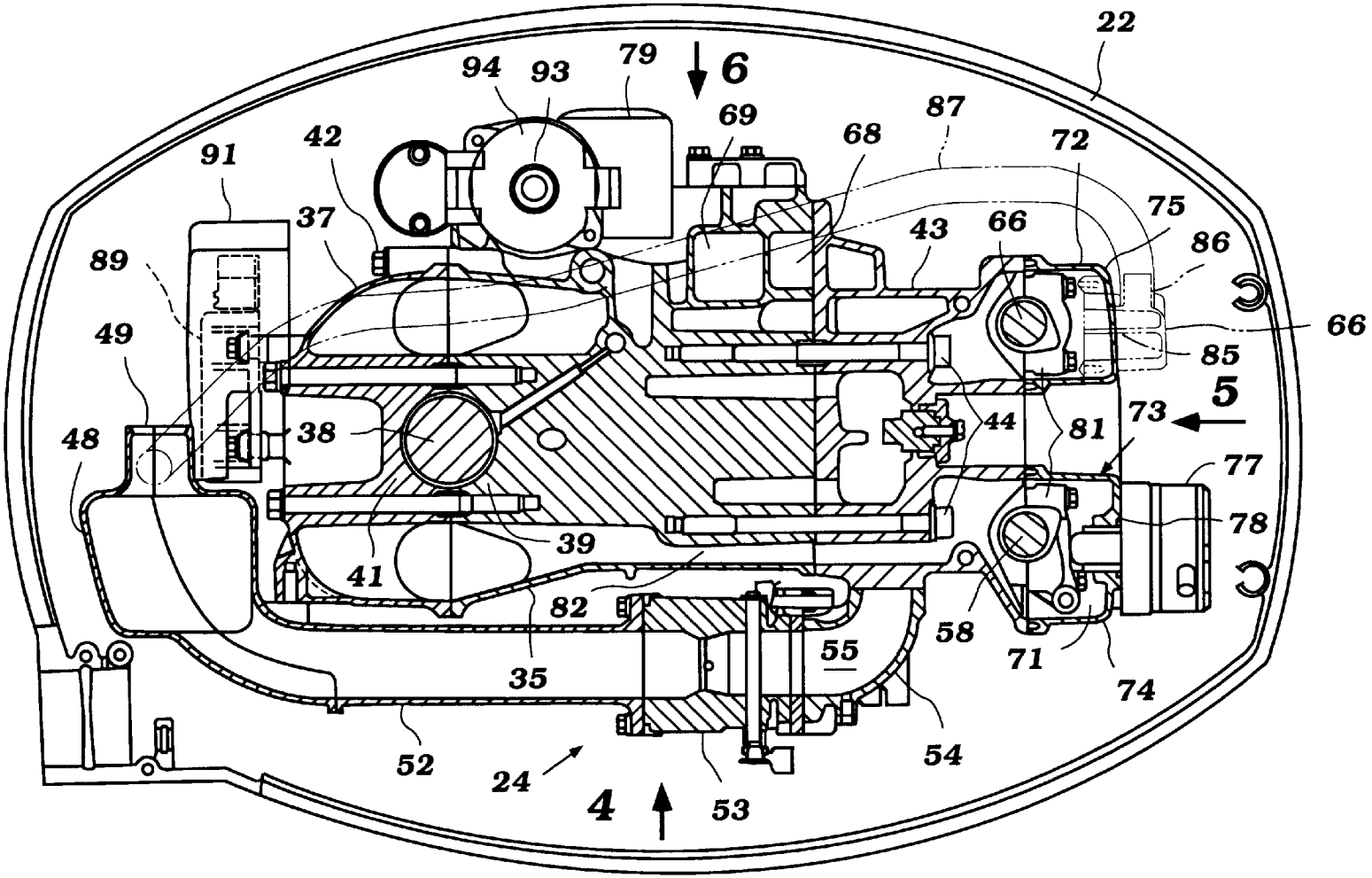
FIG. 2 is a top plan view of the outboard motor power head with the main cowling member removed and showing the engine in cross section taken on a horizontal plane passing between two cylinders to show the crankshaft bearing arrangement.

The opposite ends of the cylinder bores 36 are closed by a cylinder head assembly that is comprised primarily of a main cylinder head member 43. This cylinder head member 43 is affixed to the cylinder block 35 by threaded fasteners 44 (FIG. 2).

Pistons 45 are slidably supported in the cylinder bores 36. These pistons 45 are connected to the small ends of connecting rods 46 by piston pins. The big ends of these connecting rods 46 are journaled on the throws of the crankshaft 38 in a manner well known in the art. The cylinder head 43 is formed with recesses 47 that cooperate with the heads of the pistons 45 and the cylinder bores 36 to define the combustion chambers of the engine.

An induction system, positioned primarily on the left hand side of the outboard motor 21, is provided for delivering an air charge to these combustion chambers. This induction system includes an elongated, generally vertically extending air inlet device and silencer mechanism 48 that is disposed adjacent the forward end of the crankcase member 37 and which has a sidewardly directed air inlet opening 49. This inlet opening 49 admits air that has been drawn into the protective cowling member 24 through a rearwardly facing air inlet opening formed in part by a cover member 51 (FIG. 1).

The air from the inlet device 48 passes through a plurality of runner sections 52 to throttle bodies 53. The throttle bodies 53 have throttle valves positioned in them that are controlled by the operator through a suitable linkage or cable system.

Air passing through the throttle bodies 53 is delivered to an intake manifold 54 that has runner sections 55, each of which cooperates with one or more intake passages 56 formed in the cylinder head assembly and specifically the main cylinder head member 43. These intake passages terminate at intake valve seats formed in the cylinder head recesses 47. An intake valve arrangement 57 is mounted in the cylinder head assembly and specifically the main cylinder head member 43 for controlling the flow through these intake valve seats.

These intake valves 57 are actuated by the lobes of an intake camshaft 58 that is rotatably journaled in the cylinder head member 43 in a manner that will be described. This intake camshaft 58 is driven by a timing belt 59 (FIGS. 4–7) that engages a drive sprocket 61 fixed to an upper end of the cam shaft 58. The timing belt 59 is driven by a timing pulley (not shown) that is connected to the crankshaft. The size of the pulleys is such that the intake cam shaft 58 is driven at one-half crankshaft speed.

Figure 8:
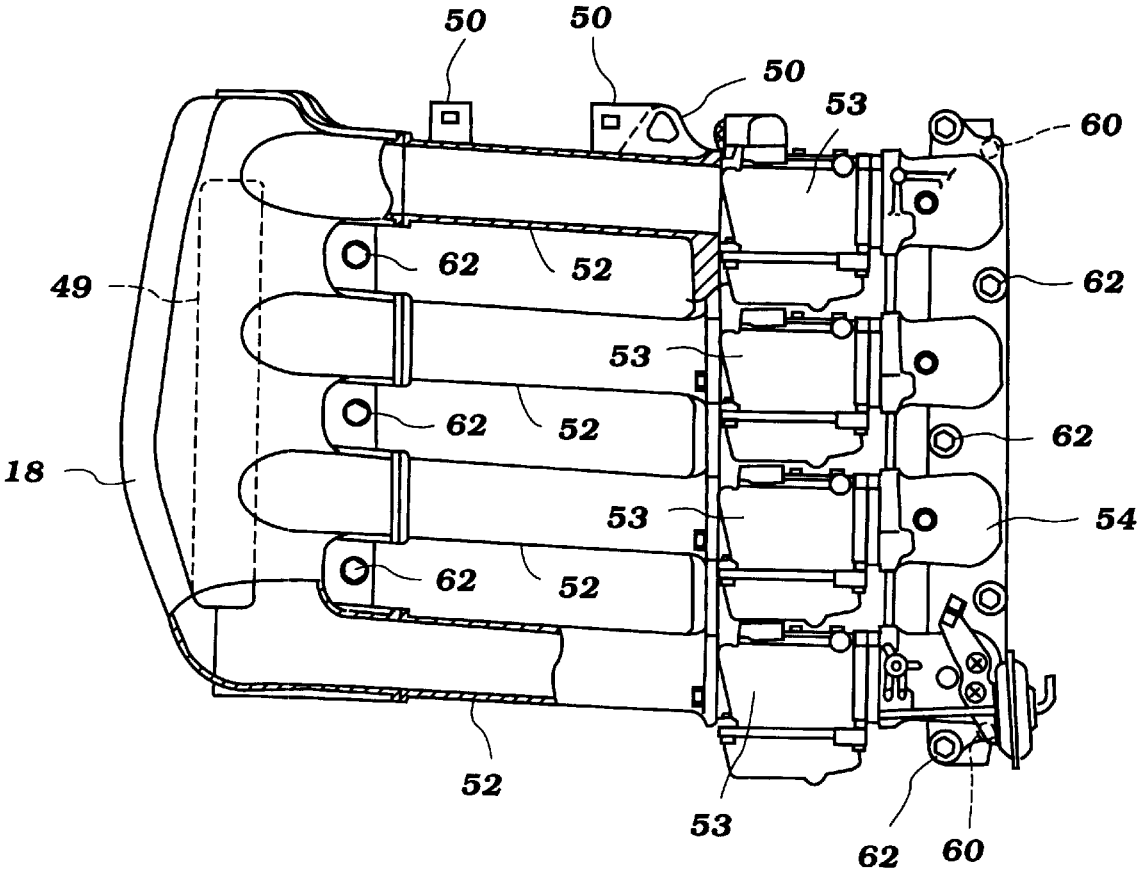
FIG. 8 is a view looking in the same direction as FIG. 4 but showing only the engine induction system.
Figure 9:
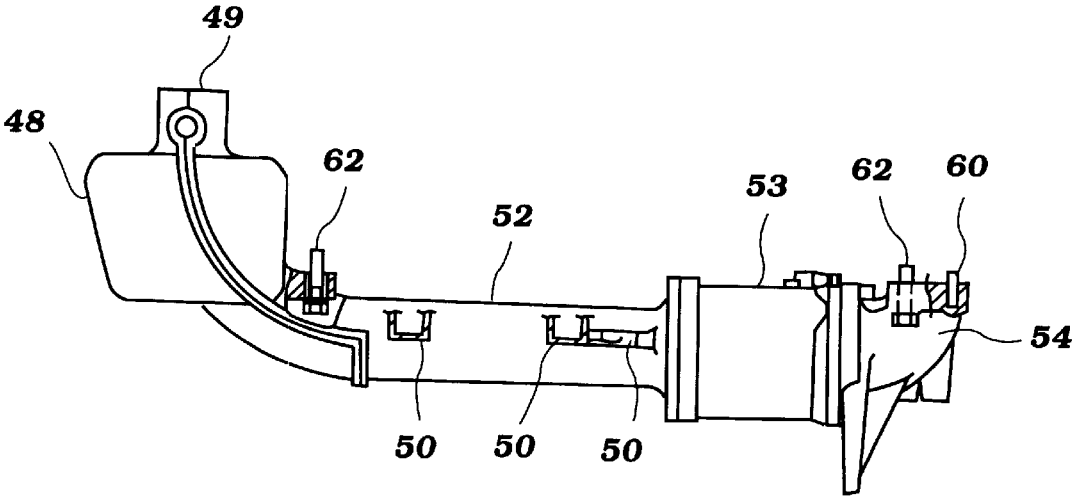
FIG. 9 is a top plan view of the portion of the engine induction system shown in FIG. 8.

As best seen in FIGS. 8 and 9, the intake manifold 54 and the intake device 48 have flange portions through which threaded fasteners 62 extend so as to affix the induction system to the left hand side of the engine. As also seen in this figure, the lowermost intake pipe 52 extends so that it blends into the bottom wall of the intake device 48 so that there is no void area at the bottom of the intake device 48 where liquids could collect. Thus it is not necessary to include any drain hole in this area to drain condensed liquids. Also, as clearly seen in FIGS. 4 and 8, the intake pipes 52 all have a slight downhill run from their inlet ends to their discharged ends at the throttle bodies 53.

The entire induction system comprised of the plenum chamber 48, the runners 52, the throttle bodies 53 and the intake manifold 54 may be assembled as a unit before attachment to the remainder of the engine 24. To assist in this, keep the weight relatively low and maintain the desired center of gravity, the plenum chamber 48 and runner sections 52 may be formed from a synthetic resin. Further hangers 50 may be formed on the uppermost runner 52 in proximity to the upper area of the center of gravity to accept other fasteners for attachment to the cylinder block 35.

Locating pins 60 are provided between the intake manifold 54 and the cylinder head 43 so as to assist in the accurate positioning of the intake system to the cylinder head member 43 with the passages in good registry therewith. After this location is completed, the fasteners 62 may be installed or tightened.

Figure 5:
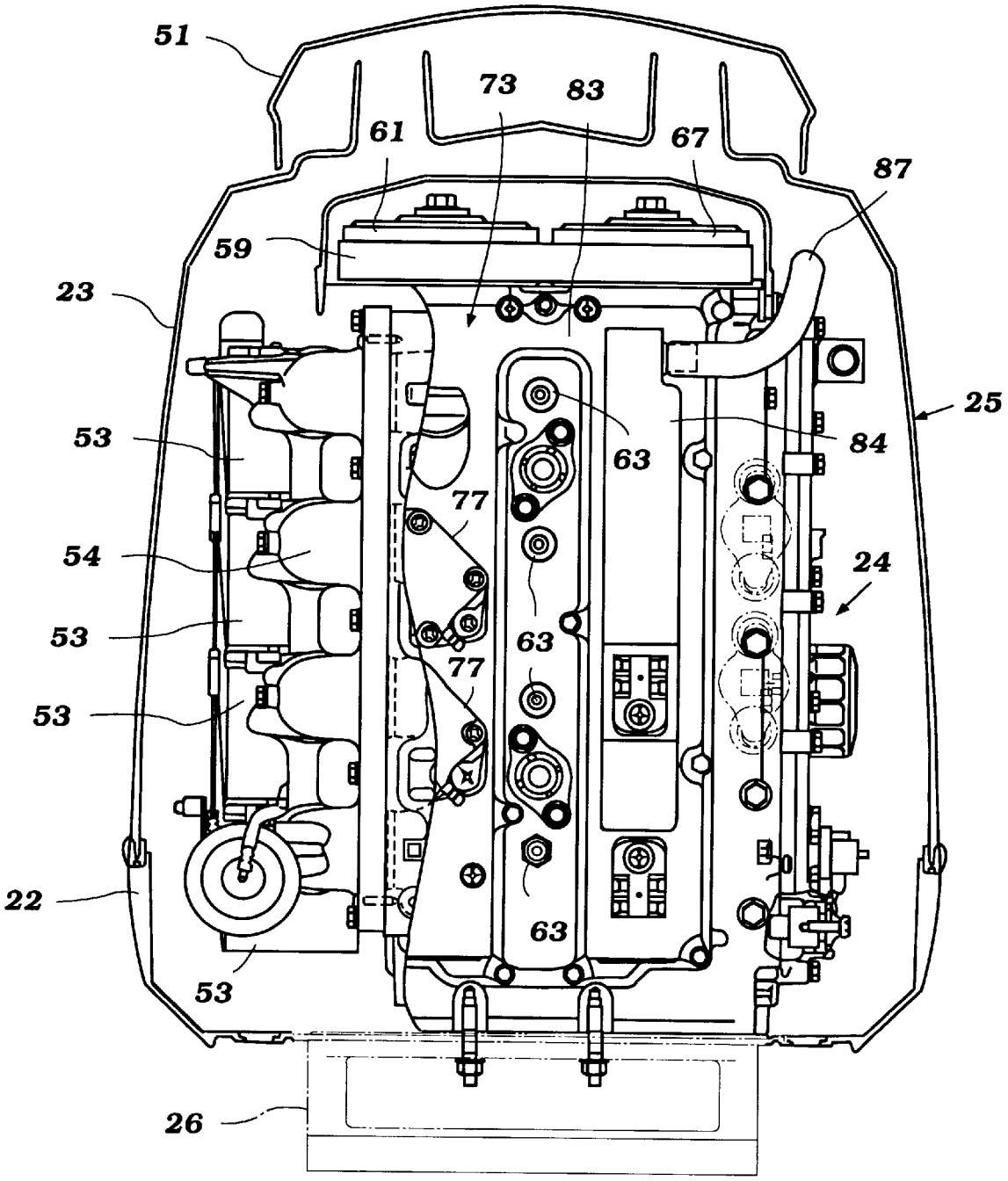
FIG. 5 is a rear elevational view, looking in the direction of the arrow 5 in FIG. 2 and again showing the engine in solid lines and the surrounding protective cowling in phantom.

As seen best in FIG. 5, spark plugs 63 are mounted in the cylinder head assembly and specifically the main cylinder head member 43. These spark plugs 63 have their spark gaps disposed in the recessed areas 47 for firing a fuel air charge which has been formed therein.

This fuel air charge may be formed by utilizing either one or more carburetors, which can be positioned as the throttle body 53 or by means of a fuel injection system. The fuel injection system may include injectors that inject fuel into either the induction system or directly into the cylinder head recesses 47. Since this fuel charging system forms no part of the invention, it has not been illustrated and those skilled in the art will readily understand how the invention can be utilized in conjunction with any wide variety of types of charge formers.

The ignited charge will burn and expand so as to drive the pistons 45 in the cylinder bores 36 and effect rotation of the crankshaft 38 as is well known in the art.

The burned charge is discharged from the combustion chambers through an exhaust system which is generally formed on the opposite side of the engine from the intake system. This includes one or more exhaust passages 64 formed in the cylinder head body 43 and which originate at exhaust valve seats formed in the cylinder head recesses 47. Poppet type exhaust valves 65 valve these exhaust valve seats.

Like the intake valve 57, the exhaust valves 65 are operated by any known type of mechanism which includes the cam lobes of an exhaust camshaft 66 that is journaled in the cylinder head member 43 for rotation about an axis that is parallel to the axis of rotation of the intake camshaft 58 and the crankshaft 38. This journal arrangement will also be described in more detail later. A driven sprocket 67 is affixed to the upper end of the exhaust camshaft 66 and is also driven by the drive belt 59 at one-half crankshaft speed. The cylinder head exhaust passages 64 have a reentrant curvature and communicate with exhaust manifold runner sections 68 formed in a facing surface of the cylinder block 65. These exhaust manifold runners 68 communicate with a collector section 69 which extends vertically downwardly and which cooperates with an exhaust system through an opening formed in the exhaust guide plate 26.

This exhaust system may have any known type of silencing mechanism and generally consists of a high-speed, underwater exhaust discharge and an idle above the water exhaust discharge. Since these systems are well known, further description of them is not believed to be necessary to permit those skilled in the art to practice the invention.

Figure 3:
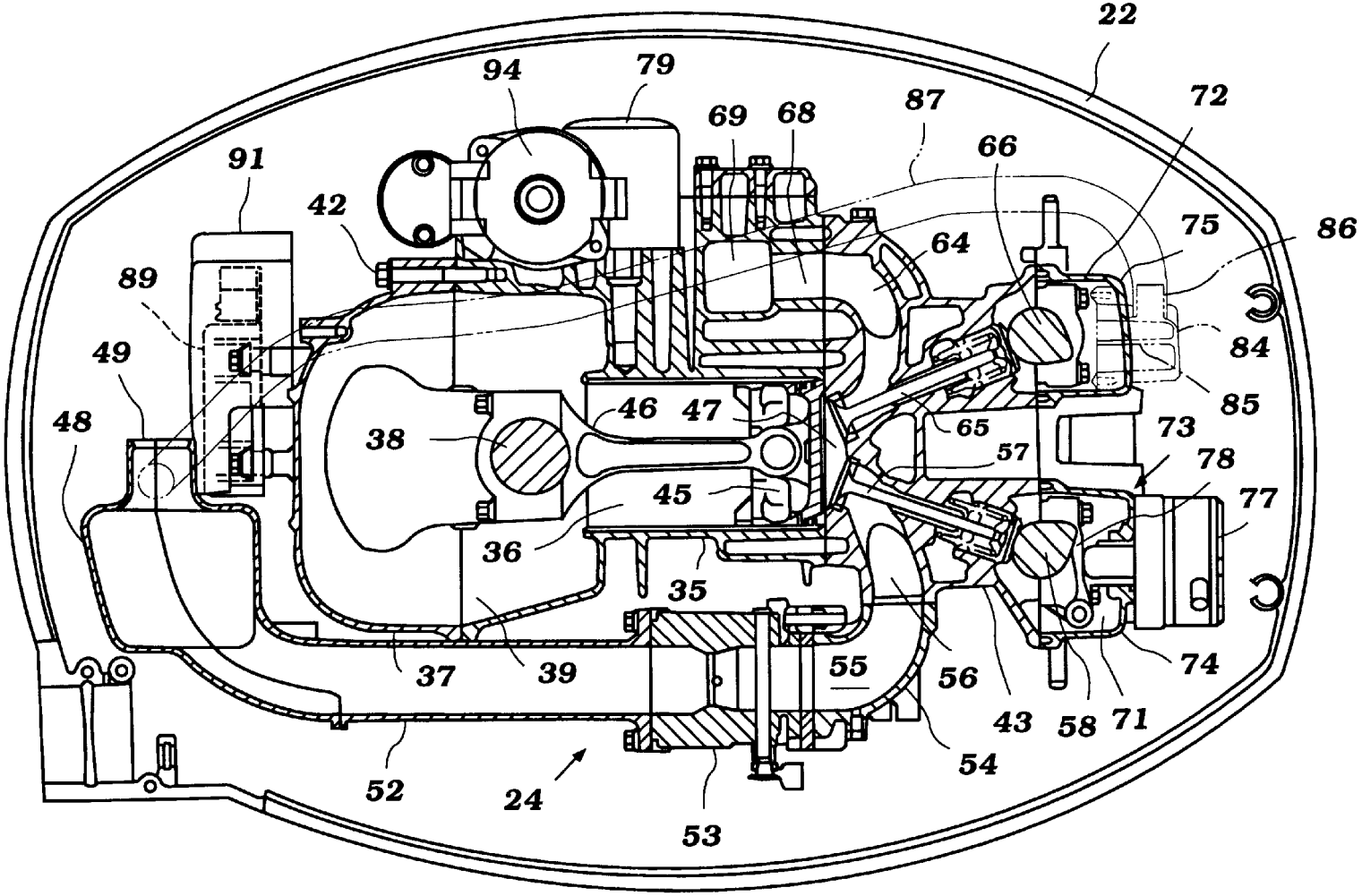
FIG. 3 is a top plan view of the outboard motor power head, in part similar to FIG. 2 but showing the engine in cross section taken on a horizontal plane passing through the axis of one of the cylinders.
Figure 4:
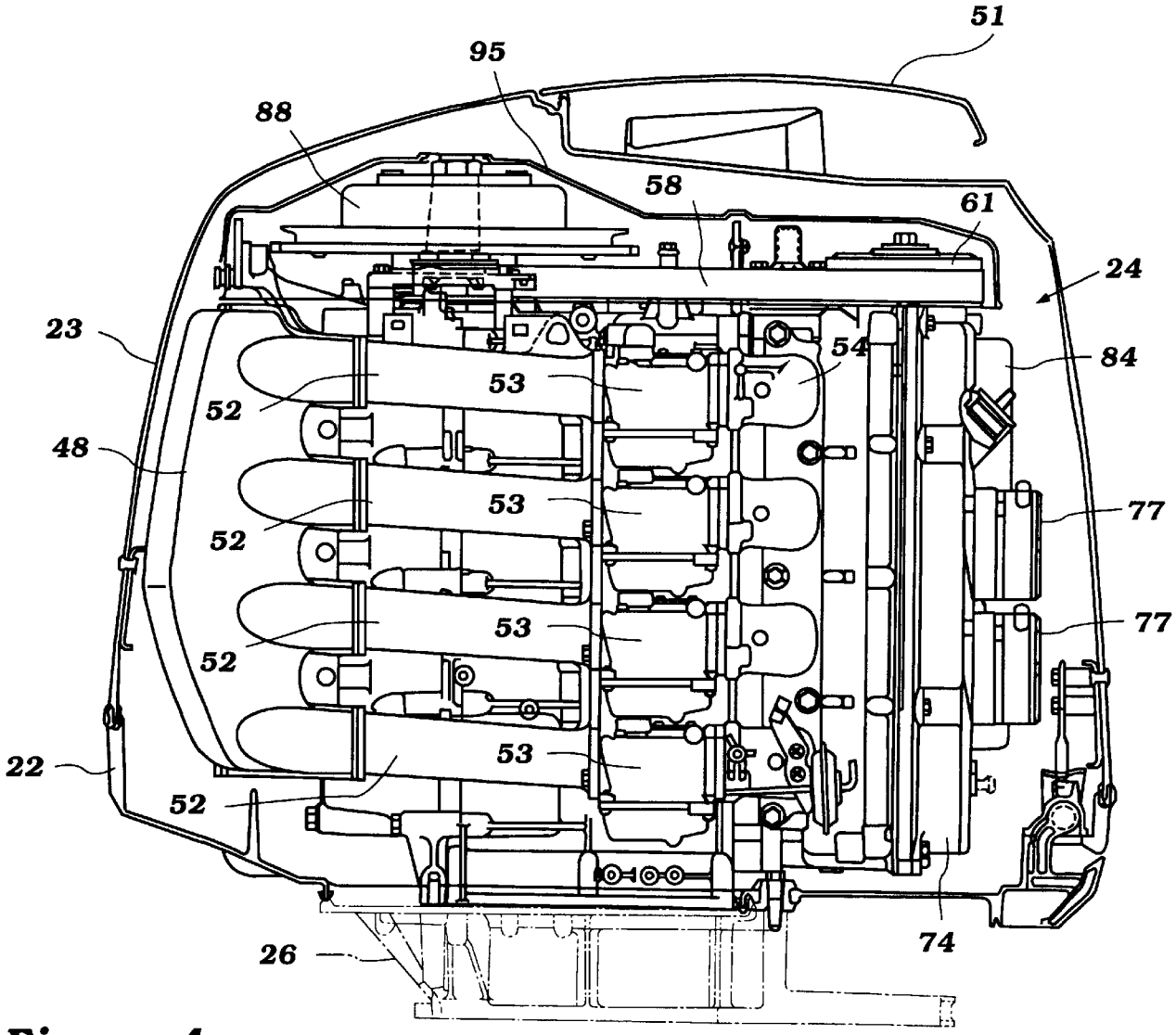
FIG. 4 is a left side elevational view, looking in the direction of the arrow 4 in FIG. 2 and showing primarily the power head with the protective cowling removed and with the part of the engine broken away and shown in section.

As seen in FIG. 3, the cylinder head member 43 forms a pair of cavities in its rearward surface indicated by the reference numerals 71 and 72 which may be considered to be intake and exhaust cam chambers. These cam chambers are closed by a single cam cover 73 that has portions 74 and 75 that overlie and close the recesses 71 and 72. A sealing gasket 76 is provided in the peripheral edge of the cam cover 73 to effect a tight oil seal between it and the cylinder head member 43.

Although the charge-forming system for the engine may be of any type, as seen best in FIGS. 2–5, a pair of fuel pumps 77 are mounted on the intake side 74 of the cam cover 73. These are operated from cam lobes on the intake camshaft 58 via finger followers 78 (FIGS. 2 and 3) so as to effect their pumping operation.

A lubricating system of any suitable type is provided for the engine 24. This lubricating system preferably is comprised of an oil reservoir (not shown) which is mounted on the underside of the exhaust guide plate 26 and which depends into the drive shaft housing and lower unit 27 and more particularly to the upper portion of the drive shaft housing part thereof. Oil is drawn from this reservoir by a suitably driven pump and circulated through the various bearing surfaces after passing through a cartridge type oil filter 79 that is mounted on the exhaust side of the engine. The bearing surfaces lubricated include those for the intake and exhaust cam shafts 58 and 66.

The intake and exhaust cam shafts 58 and 66 are journalled in the cam chambers 71 and 72 respectively by bearing surfaces formed in the cylinder head member 43. Bearing caps 81 are fixed at locations along the length of the respective cam shaft 58 and 66 and cooperate with these cylinder head bearing surfaces.

Except for the crankcase ventilation system, the engine lubricating system forms no part of the invention. Therefore fiurther description of it is not necessary for those skilled in the art to practice the invention. The oil is also returned to the aforenoted but not illustrated oil tank through a suitable drain arrangement.

The system for ventilating the crankcase chamber and the cam chambers 71 and 72, will now be described first by reference to FIGS. 1 and 2. Blowby gases that escape past the pistons 45 flow into the crankcase chamber. These gasses then flow toward the intake camshaft chamber 71 through a plurality of passages 82 that are formed in the cylinder block 35 on the intake side of the engine.

Figure 6:
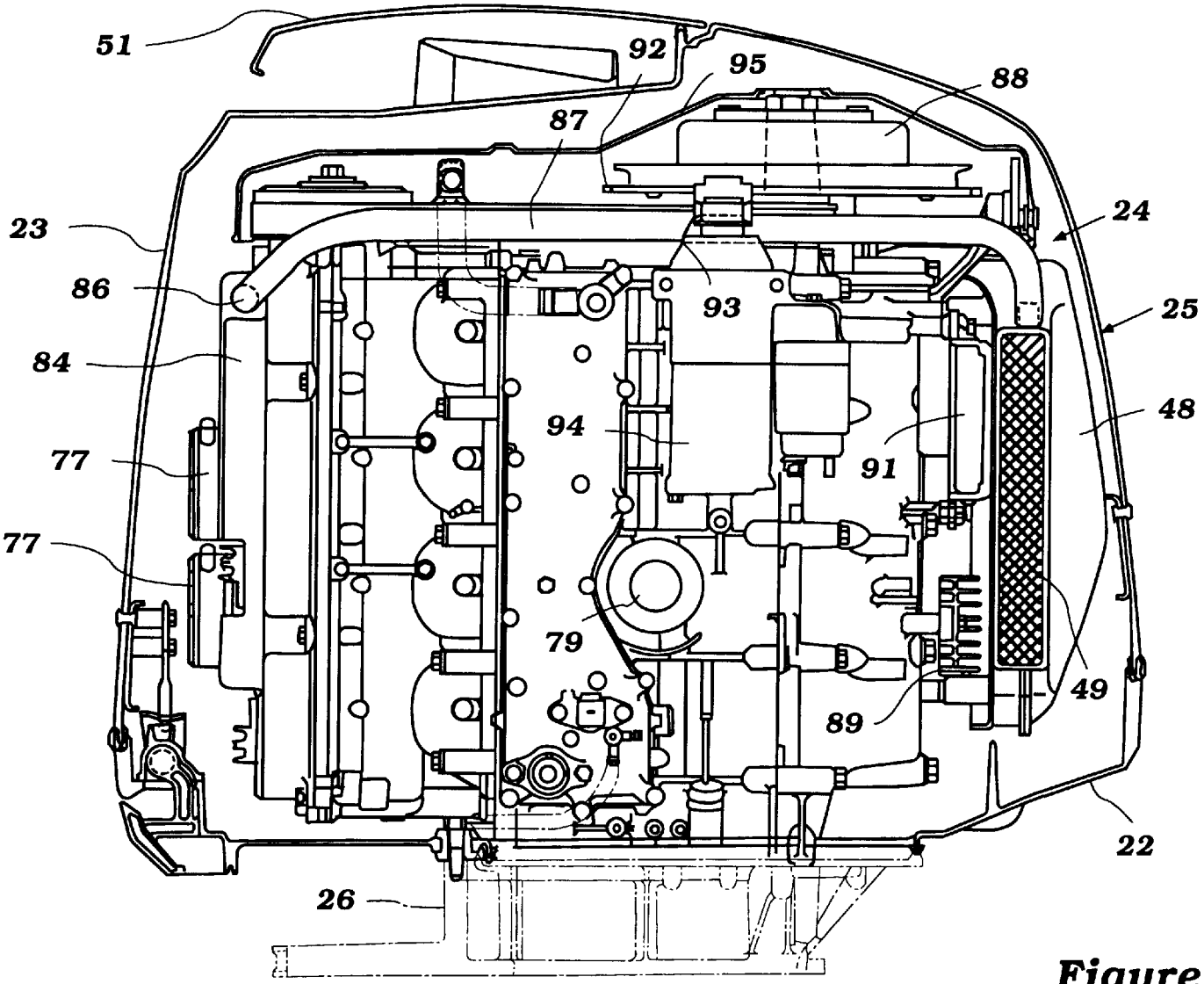
FIG. 6 is a right side elevational view of the power head looking generally in the direction of the arrow 6 in FIG. 2.
Figure 7:
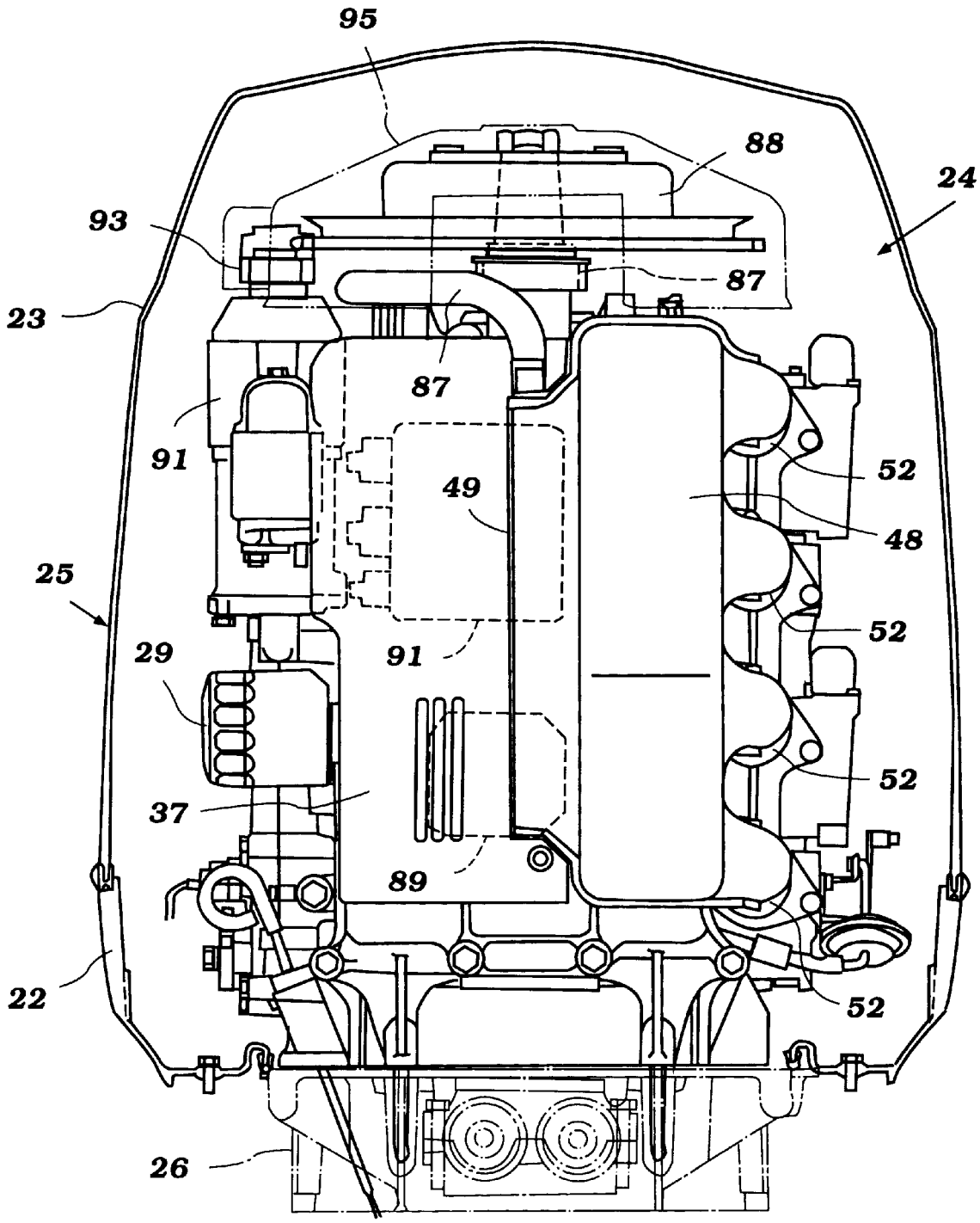
FIG. 7 is a front-elevational view of the power head looking generally in the direction of the arrow 6 in FIG. 2.

These passages 82 are basically formed between adjacent cylinders on opposite sides of the bearing webs 39 as also seen in FIG. 6. These gases then enter the intake camshaft chamber 71. While flowing through the cylinder block passages 82, any entrained oil will tend to precipitate out and drain back to the oil reservoir through the oil return path.

Once in the intake camshaft chamber 71, these crankcase ventilation gases may then flow across to the exhaust camshaft chamber 72. This flow can occur both through a restricted passageway (not shown) at the lower end of the cylinder head 43 and also through a larger, somewhat less restricted passageway formed at the upper end of the cylinder head member 46 by a bridging portion 83 (FIG. 5) of the cam cover 73.

When these gases then enter the exhaust camshaft chamber 71, they may be discharged through a separator arrangement, indicated by the reference numeral 84 best shown in FIGS. 2 and 3. This separator 84 is formed integrally in the cam cover 73. This includes a downwardly extending baffle 85 that separates the interior of the separator 84 into a pair of sections. One of the sections is in communication with the chamber 72 through a ventilating inlet opening at the upper end of the separator 84.

Thus, the ventilating gases must flow downwardly along the wall 84 and then back upwardly to a ventilating gas discharge nipple 86 formed in the exterior of the cam cover 73 exhaust side 75. A flexible conduit 87 interconnects this discharge nipple 86 with the induction system inlet section 49.

It will be seen that the flexible conduit 87 extends from one end of the power head, i.e., the rear end, forwardly and partially across the engine to the intake device air inlet portion 49. This brings the conduit 87 across the upper end of the exhaust manifold and specifically its uppermost runner section 68 and the upper end of the collector section 69.

This will cause some heat generation that should vaporize any water that remains after the air has flown through this circuitous path as well as any oil that may still remain in the blowby gases.

Because of the upper introduction of the ventilating gasses to the plenum chamber inlet 49, the crankcase gasses will be distributed equally to all cylinders and mixed well with the fresh intake air. The downhill slant of the runners 52 will also insure that any condensed liquids will be passed into the cylinders for combustion therein.

It has been noted that the timing belt 59 is driven by a timing pulley that is affixed to the upper end of the crankshaft 58. This timing pulley does not appear in the drawing but it is positioned immediately below a flywheel magneto assembly 88 that is affixed to the upper end of the crankshaft 38. This flywheel magneto 88 has a charging system which is employed for providing a charge for firing the spark plugs 63.

The output from the magneto generator charging coil is transmitted to a voltage regulator rectifier device 89 that is mounted at a cool place on the engine and specifically on the forward facing surface of the crankcase member 37 and in an area in proximity to the intake device air inlet 49 so as to be cooled. This rectifier regulator 89 supplies electrical power to a control device 91 which is mounted above it and also on the crankcase member 37 in proximity to the air inlet device 49 for cooling purposes. This control device 91 transmits a signal to the ignition system for the engine for firing the spark plugs 63 in a well known manner.

The flywheel magneto 88 is also provided with a ring gear 92 that is adapted to be engaged by a pinion gear 93 affixed to the shaft of a starter motor 94. The starter motor 94 is mounted on the exhaust side of the engine and is employed for starting the engine 24 in a well known manner.

A cover plate 95 overlies the timing drive mechanism to protect it from direct contact with atmospheric elements and particularly any water vapor that may be contained within the inducted air.

Thus, it is believed that apparent from the foregoing description, that the described construction provides a very adequate blowby and crankcase ventilation system for a four cycle outboard motor and is particularly adapted for utilization in conjunction with engine constructions in any type of environment where the engine is positioned so that its crankshaft rotates about a vertically extending axis. The flow path for the ventilating and blowby gases is such that oil vapors will be separated and returned back to the engine lubricating system equally to the cylinders where harmfil constituents will be heated and vaporized so that they can be easily burned in the combustion chambers of the engine to avoid the emission of unwanted hydrocarbons to the atmosphere.

It should be apparent that the foregoing description is that of the preferred embodiment of the invention and that various changes and modifications may be made without departing from the spirit and scope of the invention, as defined by the appended claims.

We claim:

1. An internal combustion engine having a cylinder block closed at one end by a crankcase member and at the other end by a cylinder head, said cylinder block defining at least one cylinder bore in which a piston reciprocates to form, in part, a respective combustion chamber, a crankshaft that is rotatably journaled in a crankcase chamber formed by said crankcase member and said cylinder block and driven by said piston, an overhead camshaft mounted for rotation in a camshaft chamber of said cylinder head for actuating at least one valve, a crankcase ventilating system for delivering crankcase gases through said cylinder block from said crankcase chamber to said camshaft chamber, an induction system for delivering an air charge to said combustion chamber, said induction system including a plenum chamber disposed along a side of said crankcase member opposite from said cylinder head, an atmospheric air inlet for admitting air into said plenum chamber at one side thereof, and a ventilating gas conduit extending from said camshaft chamber along an exhaust side of said engine to said plenum chamber air inlet.

2. An internal combustion engine as set forth in claim 1 wherein the exhaust side of the engine comprises an exhaust manifold formed integrally within a body of the engine and across which the ventilating gas conduit extends.

3. An internal combustion engine as set forth in claim 1 wherein the plenum chamber air inlet comprises a vertically extending air inlet and wherein the crankcase ventilating conduit extends to an upper surface thereof.

4. An internal combustion engine as set forth in claim 1 wherein there are at least two overhead camshafts mounted for rotation in the cylinder head each of which actuates at least one valve and each of which is journalled within a respective camshaft chamber, said crankcase ventilating system delivering crankcase gases through said cylinder block to a first of said camshaft chambers, from said first camshaft chamber to a second of said camshaft chambers, and the ventilating gas conduit communicates directly with said second camshaft chamber.

5. An internal combustion engine as set forth in claim 4 wherein the first camshaft chamber contains an intake camshaft that operates intake valves for the engine and the second camshaft chamber contains an exhaust camshaft for operating the exhaust valves of the engine.

6. An internal combustion engine as set forth in claim 5, wherein the cylinder block has a plurality of horizontally extending, vertically spaced cylinder bores.

7. An internal combustion engine as set forth in claim 6, wherein the crankcase chamber communicates with the first camshaft chamber through at least one passage formed on one side of the cylinder block.

8. An internal combustion engine as set forth in claim 6, further including an oil vapor separator formed in a cover that covers at least the second camshaft chamber for separating oil from the ventilating gases.

9. An outboard motor including an internal combustion engine as set forth in claim 1, said outboard motor being comprised of a power head consisting of said engine and a surrounding protective cowling, a drive shaft housing and lower unit depending from said power head and containing a propulsion device for an associated watercraft and a transmission for driving said propulsion device from said engine, said engine being mounted in said power head on an exhaust guide so that the crankshaft and camshaft rotate about parallel, vertically extending axes.

10. An outboard motor as set forth in claim 9 wherein the exhaust side of the engine comprises an exhaust manifold formed integrally within a body of the engine and across which the ventilating gas conduit extends.

11. An outboard motor as set forth in claim 9 wherein the plenum chamber air inlet comprises a vertically extending air inlet and wherein the crankcase ventilating conduit extends to an upper surface thereof.

12. An outboard motor as set forth in claim 9 wherein there are at least two overhead camshafts mounted for rotation in the cylinder head each of which actuates at least one valve and each of which is journalled within a respective camshaft chamber, said crankcase ventilating system delivering crankcase gases through said cylinder block to a first of said camshaft chambers, from said first camshaft chamber to a second of said camshaft chambers, and the ventilating gas conduit communicates directly with said second camshaft chamber.

13. An outboard motor as set forth in claim 12 wherein the first camshaft chamber contains an intake camshaft that operates intake valves for the engine and the second camshaft chamber contains an exhaust camshaft for operating the exhaust valves of the engine.

14. An outboard motor as set forth in claim 13, wherein the cylinder block has a plurality of horizontally extending, vertically spaced cylinder bores.

15. An outboard motor as set forth in claim 14, wherein the crankcase chamber communicates with the first camshaft chamber through at least one passage formed on one side of the cylinder block.

16. An outboard motor as set forth in claim 15, further including an oil vapor separator formed in a cover that covers at least the second camshaft chamber for separating oil from the ventilating gases.

17. An outboard motor as set forth in claim 16 wherein the exhaust side of the engine comprises an exhaust manifold formed integrally within a body of the engine and across which the ventilating gas conduit extends.

18. An outboard motor as set forth in claim 17 wherein the plenum chamber air inlet comprises a vertically extending air inlet and wherein the crankcase ventilating conduit extends to an upper surface thereof.

* * * * *

UNITED STATES PATENT AND TRADEMARK OFFICE

CERTIFICATE OF CORRECTION

PATENT NO. : 5,899,197
DATED : May 4, 1999
INVENTOR(S) : Watanabe et al.

It is certified that error appears in the above-identified patent and that said Letters Patent is hereby corrected as shown below:

Title page,
Item [75], second Inventor's name should read:
-- Noriyoshi Hiraoka --

Signed and Sealed this

Twelfth Day of November, 2002

*Attest:*

*Attesting Officer*

JAMES E. ROGAN
*Director of the United States Patent and Trademark Office*